US005708922A

United States Patent [19]

Azuma et al.

[11] Patent Number: 5,708,922

[45] Date of Patent: Jan. 13, 1998

[54] GUIDE MEANS AND ELECTROPHOTOGRAPHIC IMAGE FORMING APPARATUS

[75] Inventors: Jun Azuma; Yoshihisa Ibaraki, both of Yokohama, Japan

[73] Assignee: Canon Kabushiki Kaisha, Tokyo, Japan

[21] Appl. No.: 637,155

[22] Filed: Apr. 24, 1996

[30] Foreign Application Priority Data

Apr. 26, 1995 [JP] Japan ..... 7-102031

[51] Int. Cl.[6] ..... G03G 15/00

[52] U.S. Cl. ..... 399/111

[58] Field of Search ..... 355/200, 210, 355/309, 211; 399/111, 114, 121, 124

[56] References Cited

U.S. PATENT DOCUMENTS

| | | | |
|---|---|---|---|
| 4,462,677 | 7/1984 | Onoda | 355/210 |
| 5,012,294 | 4/1991 | Sasabe et al. | 355/309 |
| 5,061,959 | 10/1991 | Kinoshita et al. | 355/210 |
| 5,113,220 | 5/1992 | Kwak | 355/200 |
| 5,231,453 | 7/1993 | Nakai et al. | 355/210 |
| 5,486,898 | 1/1996 | Fujii et al. | 355/200 |
| 5,508,785 | 4/1996 | Takahashi et al. | 355/210 X |
| 5,559,581 | 9/1996 | Sagiura et al. | 355/200 |
| 5,565,961 | 10/1996 | Shoji et al. | 399/111 |

FOREIGN PATENT DOCUMENTS

| | | |
|---|---|---|
| 0163486 | 12/1985 | European Pat. Off. . |
| 0520802 | 12/1992 | European Pat. Off. . |
| 0622701 | 11/1994 | European Pat. Off. . |
| 0679965 | 11/1995 | European Pat. Off. . |

*Primary Examiner*—S. Lee

*Attorney, Agent, or Firm*—Fitzpatrick, Cella, Harper & Scinto

[57] ABSTRACT

A guide member according to the present invention is constituted by a guide portion for guiding a positioning projection provided on a process cartridge when the process cartridge is removably mounted to an image forming apparatus, a shutter guide portion for guiding a shutter projection provided on a shutter member opening/closing a transfer opening of the process cartridge when the process cartridge is removably mounted to the image forming apparatus, and a regulating portion against which the shutter projection abuts if the process cartridge is tried to be inserted into the image forming apparatus in an erroneous manner.

25 Claims, 14 Drawing Sheets

GUIDE MEANS AND ELECTROPHOTOGRAPHIC IMAGE FORMING APPARATUS

BACKGROUND OF THE INVENTION

1. Field of the Invention

The present invention relates to a guide means for guiding a process cartridge when the process cartridge is mounted to an electrophotographic image forming apparatus, and an electrophotographic image forming apparatus having such a guide means.

2. Description of the Related Art

In electrophotographic image forming apparatuses using an electrophotographic image forming process, a process cartridge incorporating an electrophotographic photosensitive member and a process means acting on the electrophotographic photosensitive member as a unit which can removably be mounted to the image forming apparatus is normally used. By using such a process cartridge, since the maintenance can by performed by an operator himself without any expert, the operability can greatly be improved. Thus, such a process cartridge has widely been used in electrophotographic image forming apparatuses.

In order to mount the process cartridge to the image forming apparatus, an insertion guide member is attached to a body of the image forming apparatus.

Further, if the process cartridge is tried to be inserted into the image forming portion in an erroneous manner, such erroneous insertion can be prevented by providing a blocking mechanism for preventing such erroneous insertion.

The present invention relates to the improvement of such a technique regarding the process cartridge.

SUMMARY OF THE INVENTION

An object of the present invention is to provide a guide means and an electrophotographic image forming apparatus, which can improve the mounting operability for mounting a process cartridge to the image forming apparatus.

Another object of the present invention is to provide a guide means and an electrophotographic image forming apparatus, wherein there are provided (i) a function for guiding a process cartridge, (ii) a function for opening a shutter member of the process cartridge and (iii) a function for preventing erroneous insertion of the process cartridge, when the process cartridge is being mounted to the image forming apparatus.

A further object of the present invention is to provide a guide means and an electrophotographic image forming apparatus, to which a process cartridge can easily be attached.

A still further object of the present invention is to provide a guide means and an electrophotographic image forming apparatus, which can be made compact, since a shutter member of a process cartridge can be opened and the process cartridge can be prevented from being inserted in a reverse condition within a small space.

Another object of the present invention is to provide a guide means and an electrophotographic image forming apparatus, which comprise a cartridge guide portion for guiding positioning projections provided on a process cartridge when the process cartridge is mounted to the image forming apparatus, a shutter guide portion for guiding a shutter projection provided on a shutter member of the process cartridge to open the shutter member covering a transfer opening of the process cartridge when the process cartridge is mounted to the image forming apparatus, and a regulating projection against which the shutter projection abuts if the process cartridge is tried to be inserted into the image forming apparatus in an erroneous manner.

DESCRIPTION OF THE PREFERRED EMBODIMENTS

The present invention will now be explained, firstly, in connection with a preferred embodiment (first embodiment), and then in connection with other embodiments.

[First Embodiment]

First of all, a first embodiment of the present invention will be explained with reference to FIGS. 1 to 13. Regarding this first embodiment, (1) an entire construction of an electrophotographic image forming apparatus and a process cartridge, (2) mounting/dismounting guide members for the process cartridge, (3) a positioning mechanism for the process cartridge, (4) a detection mechanism for the process cartridge, (5) a supporting mechanism for a fixing device, (6) a discharge portion for a recording medium, and (7) a lead wire supporting member will be described in order.

{Entire Construction}

Figure 3:
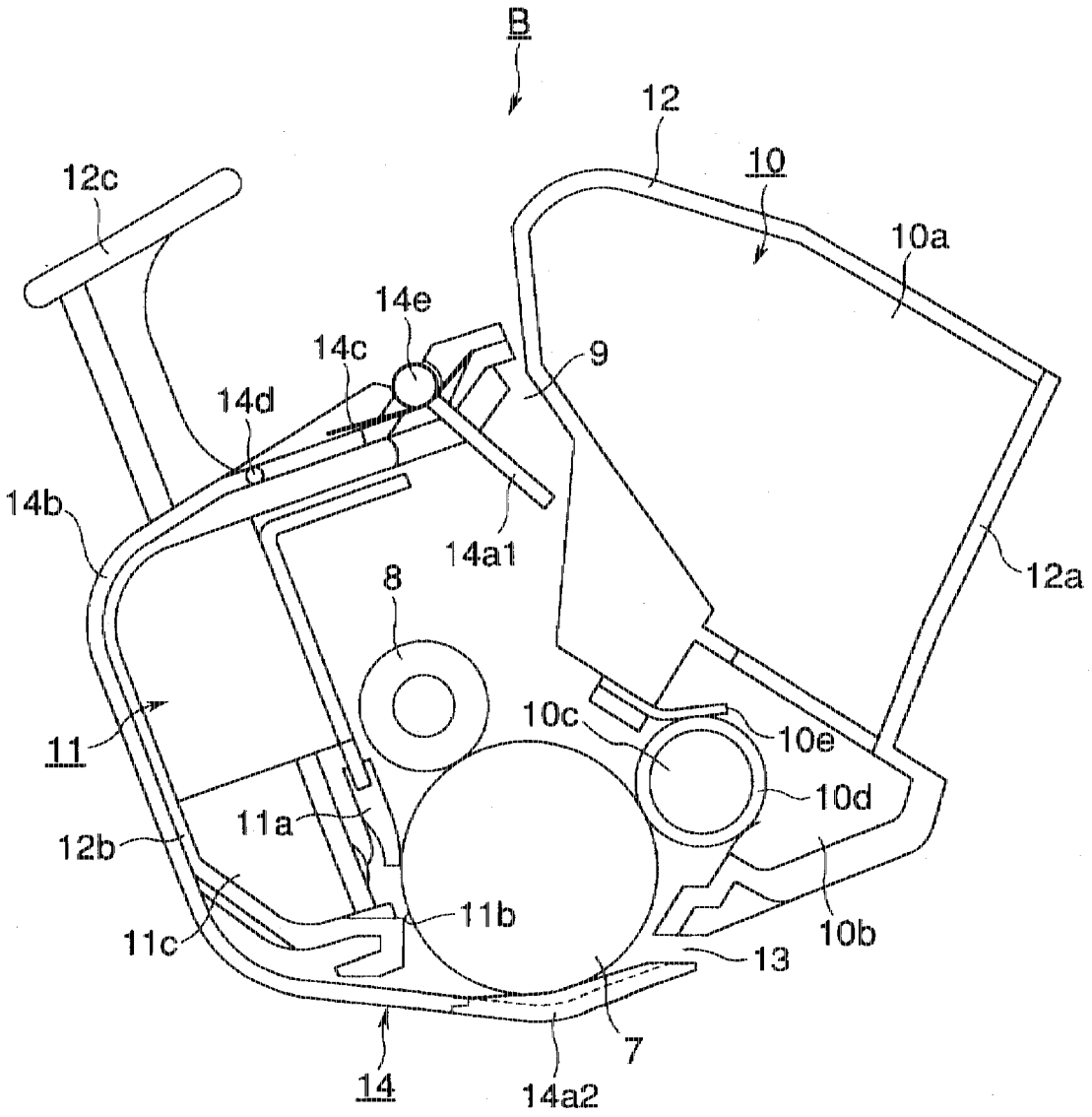
FIG. 3 is a sectional end view of a process cartridge.
Figure 4:
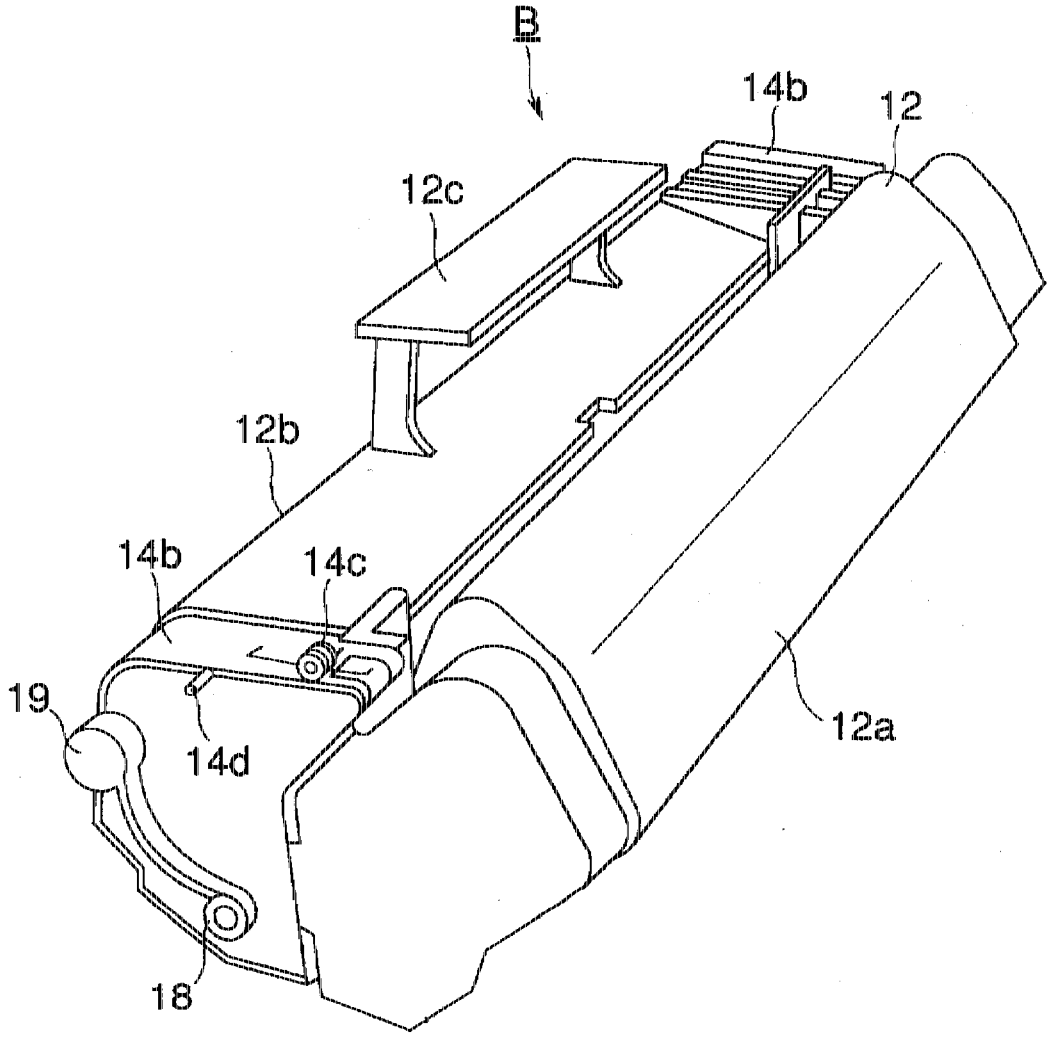
FIG. 4 is a perspective view of the process cartridge.
Figure 5:
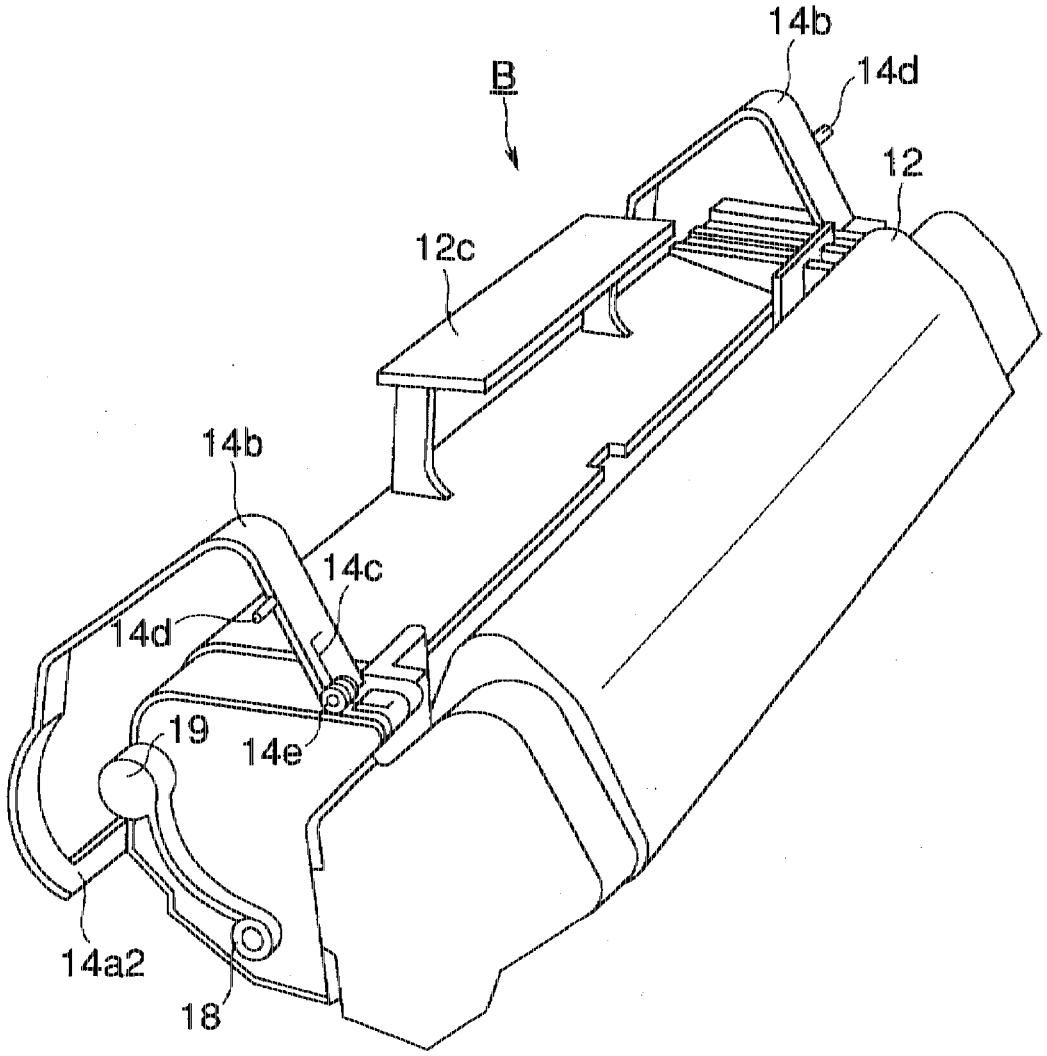
FIG. 5 is a perspective view of the process cartridge in a condition that a shutter member is opened.
Figure 6:
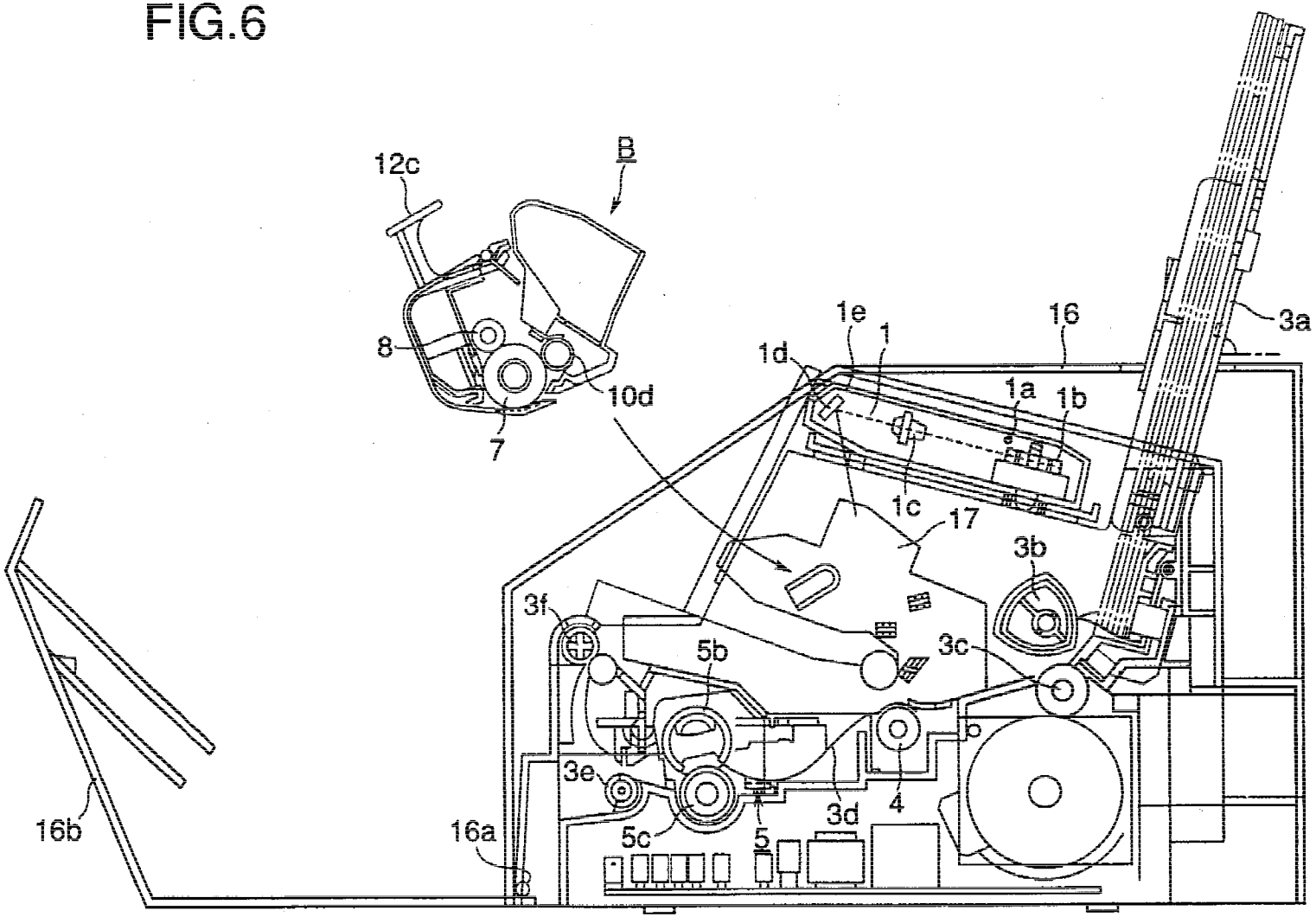
FIG. 6 is an explanatory view for showing mounting/dismounting of the process cartridge having the opened shutter with respect to the image forming apparatus.

Now, the entire construction of the electrophotographic image forming apparatus and the process cartridge will be described with reference to FIGS. 1 to 6. Incidentally, FIG. 1 is a schematic illustration showing the image forming apparatus to which the process cartridge is mounted, FIG. 2 is a perspective view of the image forming apparatus, FIG. 3 is a sectional end view of the process cartridge, FIG. 4 is a perspective view of the process cartridge, FIG. 5 is a perspective view of the process cartridge in a condition that a shutter member is opened, and FIG. 6 is an explanatory view of the process cartridge in a condition that an opening/closing cover is opened.

Figure 1:
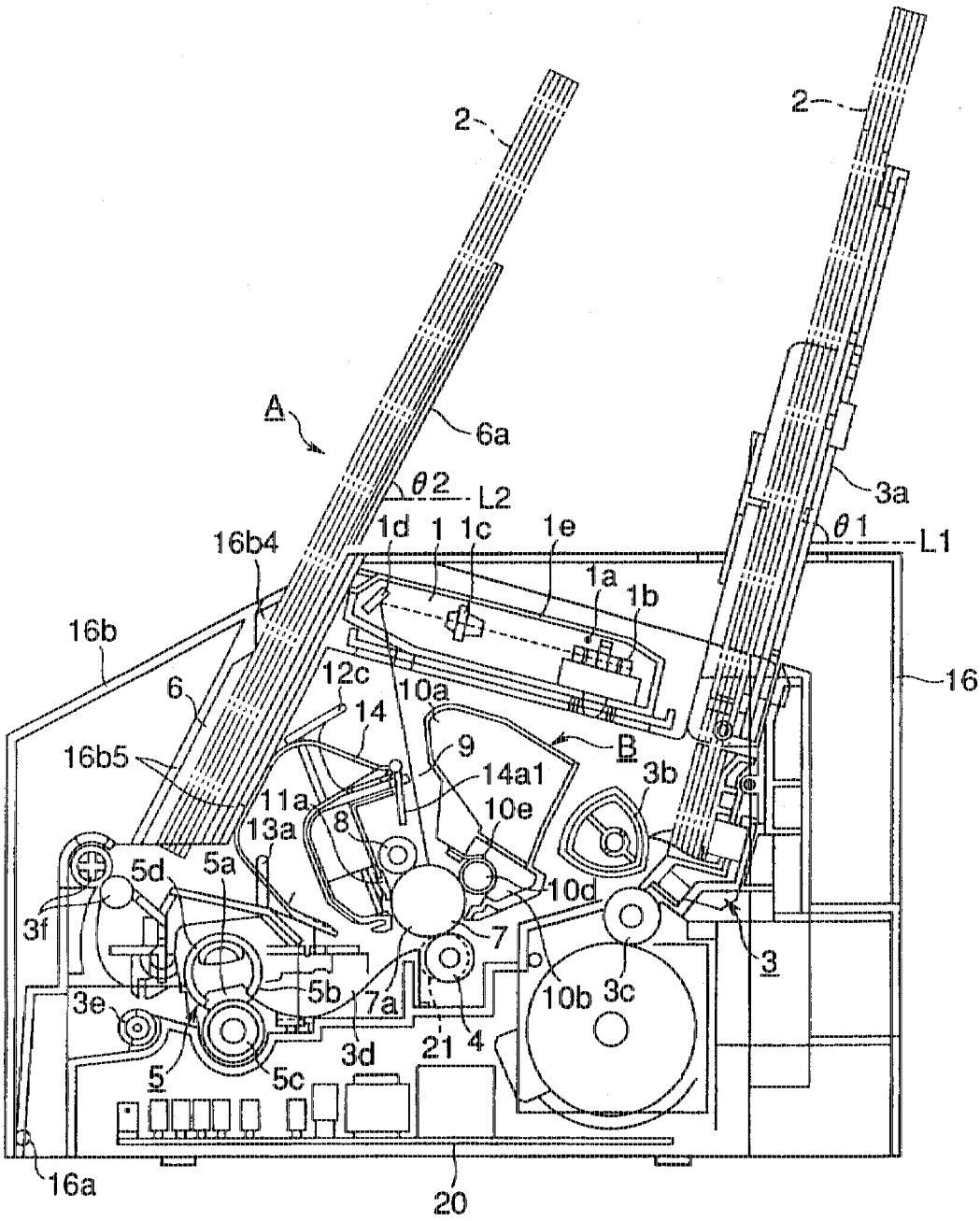
FIG. 1 is a schematic illustration showing an image forming apparatus according to a preferred embodiment of the present invention.
Figure 2:
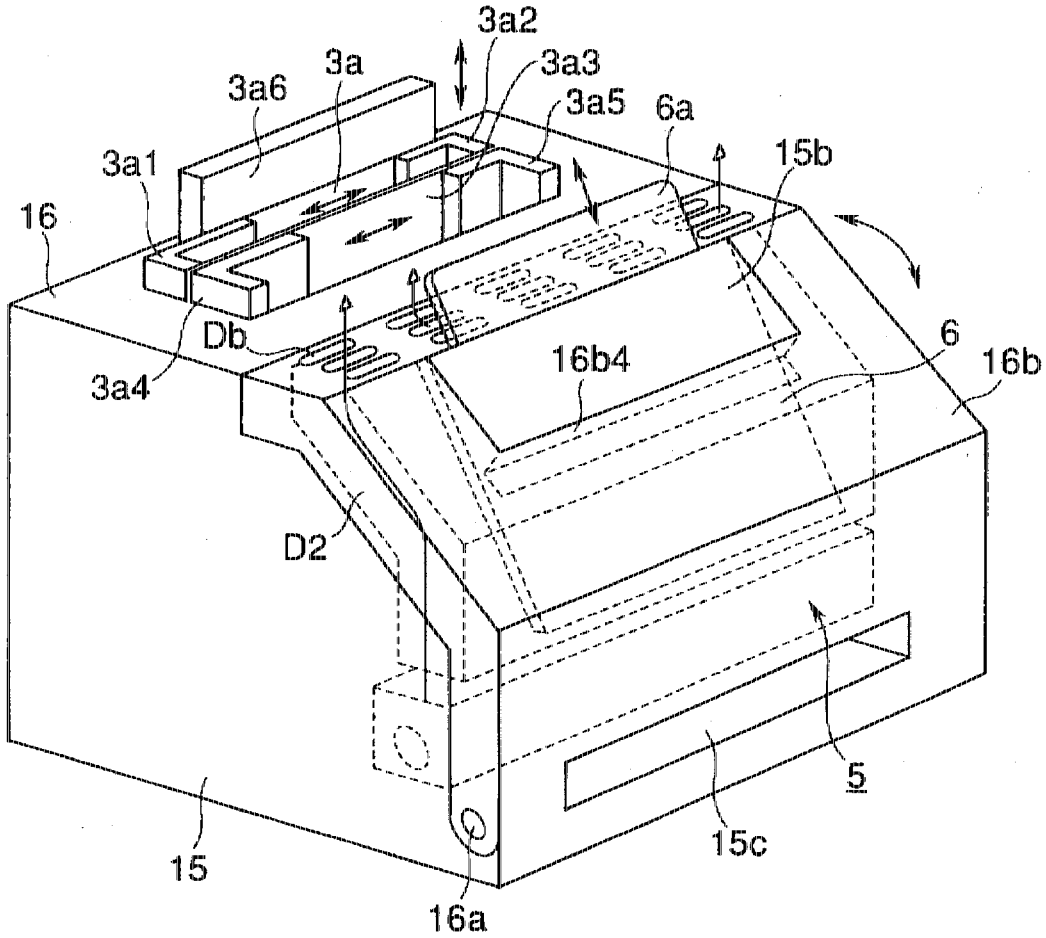
FIG. 2 is a perspective view of the image forming apparatus.

As shown in FIGS. 1 and 2, in the electrophotographic image forming apparatus (embodied as a laser beam printer in the illustrated embodiment) A, a toner image is formed on a drum-shaped electrophotographic photosensitive member (referred to as "photosensitive drum" hereinafter) 7 of the process cartridge B by an electrophotographic image forming process which will be described later. Synchronously with formation of the toner image, a recording medium (recording sheet) 2 is conveyed from a sheet supply tray 3*a* by a convey means 3 comprised of a pick-up roller 3*b* and a convey roller 3*c*. Then, the toner image formed on the photosensitive drum is transferred onto the recording sheet 2 by applying voltage to a transfer roller (transfer means) 4.

Then, the recording sheet 2 to which the toner image is transferred from the photosensitive drum 7 is sent to a fixing means 5 through a guide plate 3*d*. The fixing means 5 comprises a fixing roller 5*b* having a heater 5*a* therein, and a pressure roller 5*c* for urging the recording sheet 2 against the fixing roller 5*b* so that the toner image can be fixed to the recording sheet 2 by heat and pressure. The recording sheet 2 is then discharged onto a discharge portion 6 by a pair of discharge rollers 3*e*, 3*f*.

On the other hand, the process cartridge B includes the photosensitive drum, and at least one process means. The process means may be, for example, a charge means for charging the photosensitive drum, a developing means for developing a latent image formed on the photosensitive drum or/and a cleaning means for cleaning or removing residual toner remaining on the photosensitive drum. As shown in FIGS. 1 and 3, the process cartridge B according to the illustrated embodiment includes such charge means, developing means and cleaning means, as well as the photosensitive drum. When the photosensitive drum having a photosensitive layer thereon is rotated, by applying voltage to a charge roller (charge means) 8, a surface of the photosensitive drum is uniformly charged. Then, the latent image is formed on the photosensitive drum 7 by exposing the photosensitive drum with laser light from an optical means 1 through an exposure opening 9 in response to image information. The latent image is then developed by the developing means 10 to form the toner image. The optical system 1 includes a laser diode 1*a* for emitting the laser light in response to the image information, a polygon mirror 1*b* for scanning the photosensitive drum 7 with the laser light, a lens 1*c* and a reflection mirror 1*d*. These elements are contained in a frame 1*e* to form a laser unit.

In the developing means 10, toner contained in a toner containing portion 10*a* is sent to a developing chamber 10*b*, and a developing roller 10 provided in the developing chamber 10*b* and having a fixed magnet 10*c* therein is rotated. In this way, a toner layer having frictional charges is formed on a surface of the developing roller 10*d* by a developing blade 10*e*. The toner of the toner layer is supplied to a developing area for the photosensitive drum 7, thereby developing the latent image with toner as the toner image.

On the other hand, after the toner image is transferred to the recording sheet 2 by applying to the transfer roller 4 voltage having a polarity opposite to that of the toner image, the residual toner remaining on the photosensitive drum 7 is scraped by a cleaning blade 11*a* as the cleaning means. The scraped toner is received by a dip sheet 11*b* and then is collected in a waste toner containing portion 11*c*. In this way, the residual toner is removed from the photosensitive drum 7 by the cleaning blade 11*a*.

The above elements including the photosensitive drum 7 are supported in a cartridge frame 12 obtained by combining a developing frame 12*a* and a cleaning frame 12*b* together, which cartridge frame 12 is provided with the above-mentioned exposure opening 9 for helping the image exposure, a transfer opening 13 for opposing the photosensitive drum 7 to the recording sheet 2, and a shutter member 14 for closing and opening the transfer opening 13. As shown in FIGS. 3 and 5, the shutter member 14 has an exposure opening shutter portion 14*a*1 and a transfer opening shutter portion 14*a*2, and arms 14*b* for supporting both longitudinal ends of these shutter portions are pivotally mounted on the cartridge frame 12 via pivot shafts 14*e* and are always biased toward a shutter closing position by torsion coil springs 14*c*. When the process cartridge B is mounted to the image forming apparatus, shutter projections 14*d* formed on the arms 14*b* abut against guide members (described later), thereby automatically opening the shutter member 14. Incidentally, the shutter member 14 is closed by elastic forces of the torsion coil springs 14*c* when the shutter projections 14*d* leave the guide members (described later).

The image forming apparatus A includes an outer cover 16 forming a part of a body or frame 15 of the apparatus, and, as shown in FIG. 6, an opening/closing cover 16*b* is pivotally mounted on the outer cover 16 via pivot pins 16*a*. The guide members 17 for guiding the mounting/dismounting of the process cartridge B are disposed within the body of the image forming apparatus, so that, when the cover 16*b* is opened, the process cartridge B can be mounted and dismounted with respect to the image forming apparatus along the guide members 17.

As shown in FIG. 4, the process cartridge B is provided at its both end (corresponding to both axial ends of the photosensitive drum 7) surfaces with first positioning projections 18 and second projections 19 for maintaining the posture of the process cartridge (only one projection 18 and one projection 19 provided on one end surface are shown in FIG. 4). The first projections 18 are protruded from the cartridge frame 12 outwardly and coaxially with an axis of the photosensitive drum 7. On the other hand, although the second projections 19 are protruded from the cartridge frame 12 outwardly, they are positioned at a downstream side of the first projections 18 in a cartridge inserting direction along which the process cartridge B is inserted into the image forming apparatus A. Further, in the illustrated embodiment, a hand gripper portion 12*c* is integrally formed on an upper surface of the cartridge frame 12 so that the process cartridge B can manually be mounted and dismounted with respect to the image forming apparatus via the gripper portion 12*c*.

Incidentally, when the process cartridge B is mounted to the body 15 of the image forming apparatus, the operator opens the opening/closing cover 16*b* and mounts or dismounts the process cartridge B along a direction transverse to the axis of the photosensitive drum 7. In this case, the process cartridge B is inserted into the apparatus body 15 with the developing means 10 positioned forwardly and the cleaning means 11 rearwardly.

{Mounting/dismounting guide Members for Process Cartridge}

Figure 7:
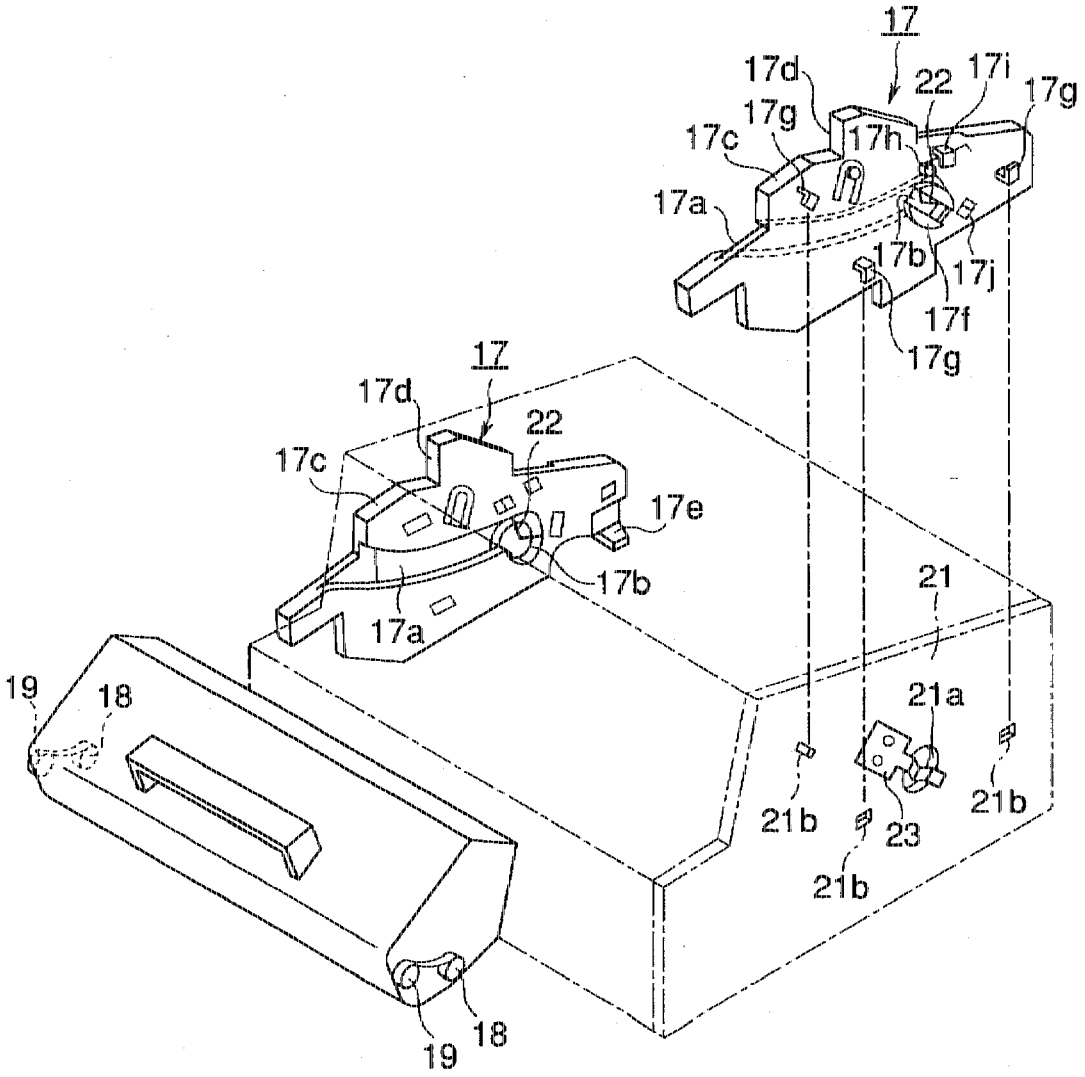
FIG. 7 is a perspective view showing cartridge mounting/dismounting guide members.

Next, the mounting/dismounting guide members 17 constituting a mounting/dismounting means for the process cartridge B will be explained. The image forming apparatus is provided with a cartridge mounting space in a confronting relation to the opening/closing cover 16*b* of the apparatus body 15, and, as shown in FIG. 7, the mounting/dismounting guide members 17 each formed from a molded member are disposed in an opposed relation within the cartridge mounting space at its both lateral ends.

Each mounting/dismounting guide member 17 has a guide groove 17*a* for guiding the corresponding first and second projections 18, 19 of the process cartridge B, which guide groove extends forwardly and downwardly along the cartridge inserting direction. The guide groove 17*a* is provided at its lower end with a positioning recess 17*b*.

Figure 8A:
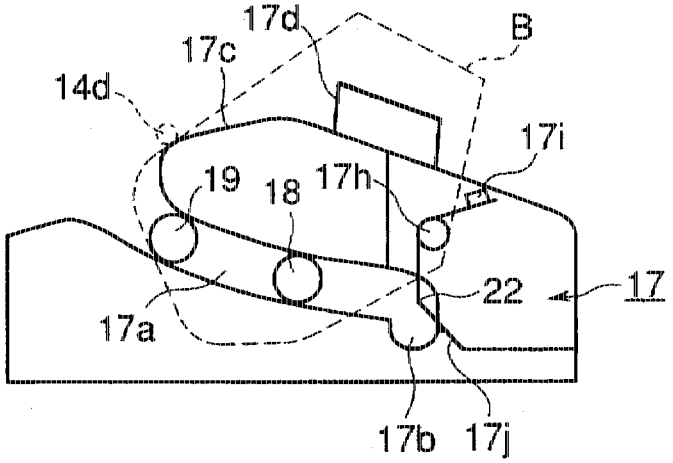
FIGS. 8A, 8B and 8C are views for explaining the insertion of the process cartridge along the cartridge mounting/dismounting guide member.
Figure 8B:
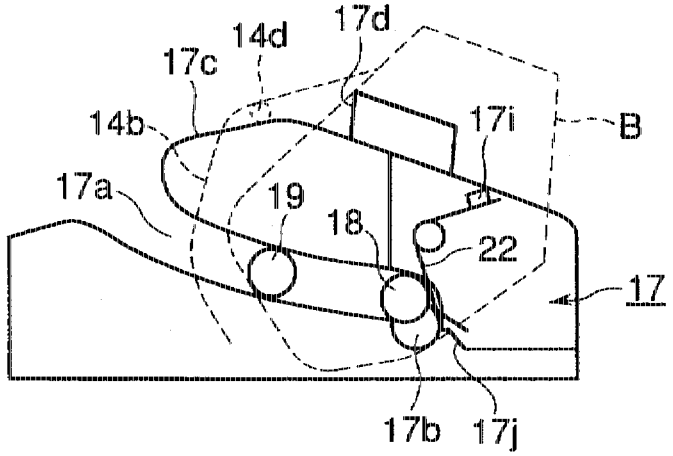
Figure 8C:
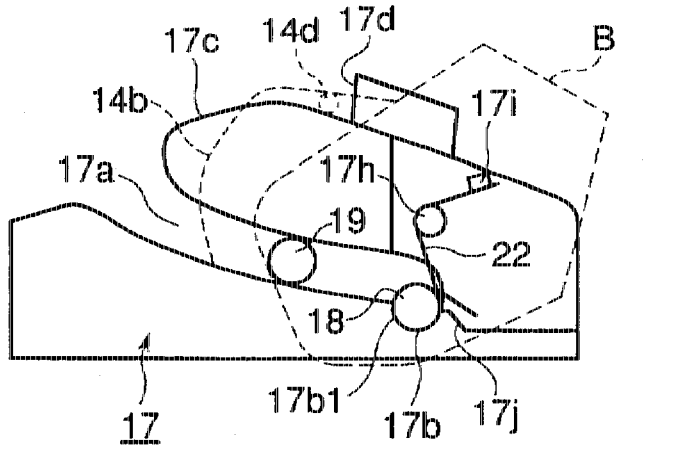

Accordingly, as shown in FIGS. 8A to 8C, when the first and second projections 18, 19 of the process cartridge B are inserted within the respective guide grooves 17*a* and are received in the respective positioning recesses 17*b* (i.e., when the process cartridge B is completely inserted into the guide grooves 17*a*), the first projections 18 are fitted into the positioning recesses 17*b* and the second projections 19 are locked in the guide grooves 17*a*, thereby maintaining the posture of the process cartridge B.

Further, each guide member 17 is provided at its upper surface with a shutter guide portion 17*c* which extends forwardly and upwardly along the cartridge inserting direction and against which the corresponding shutter projection 14*d* of the shutter arm 14*b* of the process cartridge B can abut. Thus, when the process cartridge B is inserted along the guide grooves 17*a*, the shutter projections 14*d* abut against the corresponding guide portions 17*c*. As a result, the shutter member 14 is rotated in a clockwise direction in FIGS. 8A to 8C in opposition to the elastic forces of the springs 14*c*, thereby opening the transfer opening 13 and the exposure opening 9. Consequently, the photosensitive drum 7 is exposed and is contacted with the transfer roller 4. Further, the laser light from the optical means 1 can be illuminated onto the photosensitive drum 7 through the exposure opening 9. To the contrary, when the process cartridge B is dismounted from the apparatus body 15, the shutter projections 14*d* are lowered along the inclined surfaces of the guide portions 17*c* by the elastic forces of the springs 14*c*, with the result that the shutter member 14 is rotated in an anti-clockwise direction, thereby closing the transfer opening 13 and the exposure opening 9.

Figure 9:
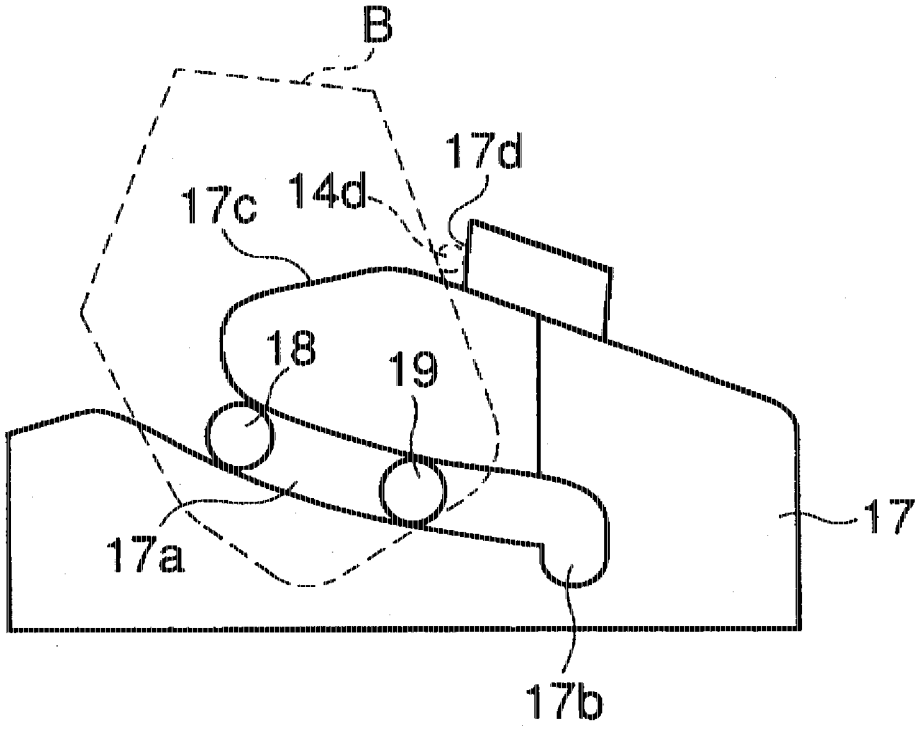
FIG. 9 is an explanatory view showing a condition that the process cartridge is tried to be inserted in a reverse manner.

Further, each guide member 17 is provided at its upper surface with a regulating projection (reverse insertion preventing portion) 17*d* for preventing reverse insertion or erroneous insertion of the process cartridge if the process cartridge B is tried to be inserted into the image forming apparatus in an erroneous manner (improper manner). As shown in FIG. 9, if the process cartridge B is tried to be inserted in the left-and-right reverse manner, i.e. a manner that the cleaning means 11 is positioned forwardly and the developing means 10 is positioned rearwardly in the cartridge inserting direction (i.e. the second projections 19 are positioned at the upstream side of the first projections 18 in the cartridge inserting direction), the shutter projection 14*d* abuts against the regulating projection 17*d*, thereby preventing the further insertion of the process cartridge B. Accordingly, if the operator tries to insert the process cartridge B into the apparatus body 15 in an erroneous manner, the process cartridge cannot be inserted completely, with the result that the operator can recognize the erroneous insertion.

By providing the cartridge reverse insertion preventing portions on the mounting/dismounting guide members 17 disposed on both ends of the cartridge mounting space in this way, an additional space for preventing the-erroneous insertion of the process cartridge is not required, the cartridge mounting space can be used efficiently.

Further, since the shutter guide portions 17*c* and the regulating projections 17*d* are integrally formed with the guide members 17, it is not required that such portions 17*c* and projections 17*d* are attached to the apparatus body 15 independently, and thus, the assembling operability for assembling the body 15 of the image forming apparatus can be improved. In addition, since the space can be saved, apparatus can be made compact.

One (left in FIG. 7) of the mounting/dismounting guide members 17 opposed to each other is provides at its front lower end (in the cartridge inserting direction) with a bent portion 17*e* extending in a horizontal direction. The bent portion 17*e* serves to prevent any metal piece (for example, a clip) from dropping onto an electric substrate 20 (refer to FIG. 1) disposed at a bottom of the apparatus body.

That is to say, below the guide member 17 having the bent portion 17*e*, there is disposed a drive transmission gear 21 (provided on the apparatus body 15) meshed with a drum gear (helical gear) 7*a* secured to one end of the photosensitive drum 7 of the process cartridge B, and the electric substrate 20 is disposed below the drive transmission gear with the interposition of a metal plate. The bent portion 17*e* is positioned above a gap between the drive transmission gear 21 and the metal plate to prevent the metal piece from dropping through the gap. Since the bent portion 17*e* is formed integrally with the guide member 17, merely by attaching the guide member 17 to the apparatus body, the metal piece can be prevented from dropping onto the electric substrate 20.

Next, explaining the attachment of the guide members 17, as shown in FIG. 7, each guide member 17 is provided at its outer surface (remote from the other guide member) with a circular locking protrusion 17*f* in alignment with the positioning recess 17*b*, and a plurality of locking pegs or pawls 17*g* disposed around the locking protrusion 17*f* (although FIG. 7 shows the outer surface of one of the guide member 17 alone, the outer surface of the other guide member has the same construction). On the other hand, a chassis 21 of the apparatus body 15 is provided with circular holes 21*a* into which the locking protrusions 17*f* can be inserted, and a plurality of locking holes 21*b* to which the locking pawls 17*g* can be locked.

When the guide members 17 are attached to the apparatus body, first of all, the locking protrusions 17*f* are inserted into the corresponding circular holes 21*a*. In this condition, when the guide members 17 are rotated by a predetermined amount, the locking pawls 17*g* are elastically snapped into the corresponding locking holes 21*b*, with the result that the guide plates 17 are secured to the metal chassis 21. Accordingly, the guide members 17 can be attached to the metal chassis 21 elastically in a one-touch fashion without using screws or the like.

As mentioned above, in the illustrated embodiment, the guide groove 17*a*, the positioning recess 17*b*, an abutment portion 17*b*1, the shutter guide portion 17*c*, the regulating projection 17*d* and the bent portion 17*e* are integrally formed with the guide members or guide member 17. More specifically, each guide member 17 is molded from plastic material.

{Positioning of Process Cartridge}

It is necessary that the process cartridge B inserted along the guide grooves of the guide members 17 having the above-mentioned construction is surely positioned with respect to the body 15 of the image forming apparatus A. Particularly, the photosensitive drum 7 must be accurately positioned with respect to the apparatus body 15 to permit the light illumination effected by the optical means 1 of the apparatus body 15 and the image transferring effected by the transfer roller 4 of the apparatus body 15. To this end, as shown in FIG. 8C, the first projections 18 of the process cartridge extending coaxial with the axis of the photosensitive drum 7 are fitted into the positioning recesses 17*b* of the guide members attached to the apparatus body. According to the illustrated embodiment, in this condition, the first projections 18 are directly urged against the respective positioning recesses 17*b* without urging the cartridge frame 12 by urging means provided on the guide members 17. That is to say, as shown in FIGS. 8A to 8C, a torsion coil spring (urging means) 22 is mounted on a projection 17*h* formed on each guide member 17. Both ends of the torsion coil spring 22 abut against stoppers 17*i*, 17*j*, respectively. The torsion coil spring 22 is attached to the corresponding guide member 17 in such a manner that a portion of the torsion coil spring 22 is protruded above the positioning recess 17*b*.

With the arrangement as mentioned above, as shown in FIGS. 8A to 8C, when the process cartridge B is inserted along the guide grooves 17*a* of the guide members 17, in an initial inserted condition, as shown in FIG. 8A, the one end of each torsion coil spring 22 is urged against the corresponding stopper 17*j*. However, as the process cartridge B is further inserted, as shown in FIG. 8B, the torsion coil spring 22 is urged by the corresponding first projection 18, with the result that one end of the torsion coil spring 22 is spaced apart from the corresponding stopper 17*j*, thereby generating a biasing force for biasing the first projection 18 downwardly and obliquely. As the process cartridge B is further inserted, as shown in FIG. 8C, the first projection 18 is dropped into the corresponding positioning recess 17*b*, thereby completing the insertion of the process cartridge B. In this case, the first projections 18 are urged downwardly and obliquely by the respective torsion coil springs 22 to be urged against the respective abutment portions 17*b*1 of the positioning recesses 17*b*. Consequently, the first projections 18 are positively positioned and secured with respect to the respective positioning recesses 17*b*.

As mentioned above, since the process cartridge is positioned with respect to the apparatus body 15 by directly urging the first projections disposed coaxially with the axis of the photosensitive drum 7 by means of the springs 22, the photosensitive drum 7 can be directly and correctly positioned with respect to the apparatus body 15.

Further, in the illustrated embodiment, since the first projections 18 are formed from metallic material, when the first projections are urged by the springs 22, the first projections are not deformed. Accordingly, unlike to the prior art, since it is not required to consider deformation of the frame of the process cartridge caused by urging the cartridge frame by any biasing means as is in the prior techniques, the forces of the springs can be minimized. Therefore, since the forces of the springs can be minimized, insertion resistance of the process cartridge B is reduced, and thus, the mounting/dismounting operability can be improved. Further, reinforcing ribs are not required to be provided on the cartridge frame.

The first projections (metal pins) are contacted with an inner surface of a cylindrical aluminum base core of the photosensitive drum 7 through contact members (not shown), and, as shown in FIG. 7, the positioning recess 17*b* (to which the first projection 18 is fitted) of one of the guide plates 17 is earthed to the metal chassis 21 via an earth plate 23. With this arrangement, when the first projections 18 are positioned in the positioning recesses 17*b* by inserting the process cartridge B, the metal pin 18 is contacted with the earth plate 23, thereby earthing the photosensitive drum 7 through the metal chassis 21. In this case, since the first projections 18 are positioned in the positioning recesses 17*b* by directly urging the projections by means of the springs 22, the metal pin is positively contacted with the earth plate 23.

As mentioned above, since the biasing means (springs) for biasing and positioning the process cartridge B are provided on the guide members 17, the cartridge biasing means are not required to be provided on the opening/closing cover 16*b* and the like and any reinforcing ribs are not required to be provided on the opening/closing cover 16*b*. Therefore, the process cartridge B can be biased with the minimum space.

As shown in FIG. 2, in the illustrated embodiment, the sheet supply tray 3*a* is arranged to protrude from a rear upper portion of the apparatus body 15 in a longitudinal direction. The sheet supply tray 3*a* serves to support the back surface (rear surface) of the recording sheet stack 2 at central and rear portions thereof, thereby supporting the sheet stack 2 in a flat condition along the longitudinal direction before the image formation. At a front side of the sheet supply tray 3*a*, there are provided two movable regulating plates 3*a*1, 3*a*2 for regulating left and right (looked at from the front side) lateral edges of the sheet stack 2, and a manual insertion guide 3*a*3 for guiding a manually inserted recording sheet 2. Incidentally, the manual insertion guide 3*a*3 is also provided with movable regulating plates 3*a*4, 3*a*5. Further, an extension guide (slider) 3*a*6 for stably supporting long recording sheets 2 is provided on an upper end of the sheet supply tray 3*a*. The extension guide can be extended and retracted with respect to the sheet supply tray 3*a*.

Incidentally, the sheet supply tray 3*a* is removably mounted in the outer cover 16 of the apparatus body 15. In the illustrated embodiment, a first supporting angle 81 for supporting the recording sheet stack 2 before the image formation, i.e., an angle 81 between the recording sheet stack 2 flatly supported by the sheet supply tray 3*a* and a horizontal plane is set to about 60 to 90 degrees. With this arrangement, the installation space for the apparatus body 15 can be reduced and the recording sheet 2 can be well supplied by utilizing the force of gravity. Incidentally, the first supporting angle θ1 is preferably set to about 70 to 75 degrees (FIG. 1).

Further, in the illustrated embodiment, the opening/closing cover 16*b* is provided with a heat discharging duct D2. Incidentally, the reference numeral 16*a* denotes pivot pins for the opening/closing cover 16*b*. Inside the opening/closing cover 16*b*, there are provided the discharge portion 6 inclined rearwardly from bottom to top, and an extension tray 6*a* slidable with respect to the discharge portion 6 in an up-and-down direction. Accordingly, after the image formation, the recording sheet 2 is discharged through an opening 15*b* formed in the cover 16*b* and is supported by the discharge portion 6 and the extension tray 6*a*. Incidentally, a short recording sheet 2 is supported by the discharge portion 6 alone. In this case, the operator can remove the recording sheets 2 supported by the discharge portion 6. Further, the opening/closing cover 16*b* is provided with three rows of outlet openings Db behind the extension tray 6*a* so that the heated air stream generated at the fixing means 5 and conveyed along the duct D2 can be discharged through the outlet openings Db. A discharge opening 15*c* formed in the opening/closing cover 16*b* serves to discharge a thick recording sheet such as a post card or the like. When the recording sheet 2 is discharged through the discharge opening 15*c*, the recording sheet is not curved, unlike the discharge to the discharge portion 6.

According to the illustrated embodiment, since the discharge portion 6 is positioned inside the opening/closing cover 16*b* and a rib 16*b*4 is formed on an inner surface of the opening/closing cover 16*b* in a confronting relation to the discharge portion 6, the recording sheets 2 can be supported more stably. A second supporting angle 82 for supporting the recording sheet stack 2 after the image formation, i.e., an angle θ2 between the recording sheet stack 2 flatly supported by the discharge portion 6 and the horizontal plane L2 is set to about 55 to 75 degrees, and preferably, about 65 to 70 degrees (refer to FIG. 1).

As mentioned above, in the illustrated embodiment, since the sheet supply tray 3*a* and the discharge portion 6 are disposed so that they can support the recording sheet stack 2 in the longitudinal direction, the installation space for the apparatus body 15 can be reduced in comparison with conventional techniques.

{Sensor Arrangement}

As mentioned above, according to the illustrated embodiment, by inserting the process cartridge B along the guide members 17 and then by closing the opening/closing cover 16*b*, the mounting of the process cartridge is complete. According to the illustrated embodiment, it is so designed that the image forming operation cannot be started (and, the laser light cannot be emitted) so long as the mounting of the process cartridge B and the closing of the opening/closing cover 16*b* are not detected. The fact that the image forming operation is not started means that all of the photosensitive drum, process means, laser unit and convey means are not driven. Next, the sensor arrangement will be explained.

Figure 10:
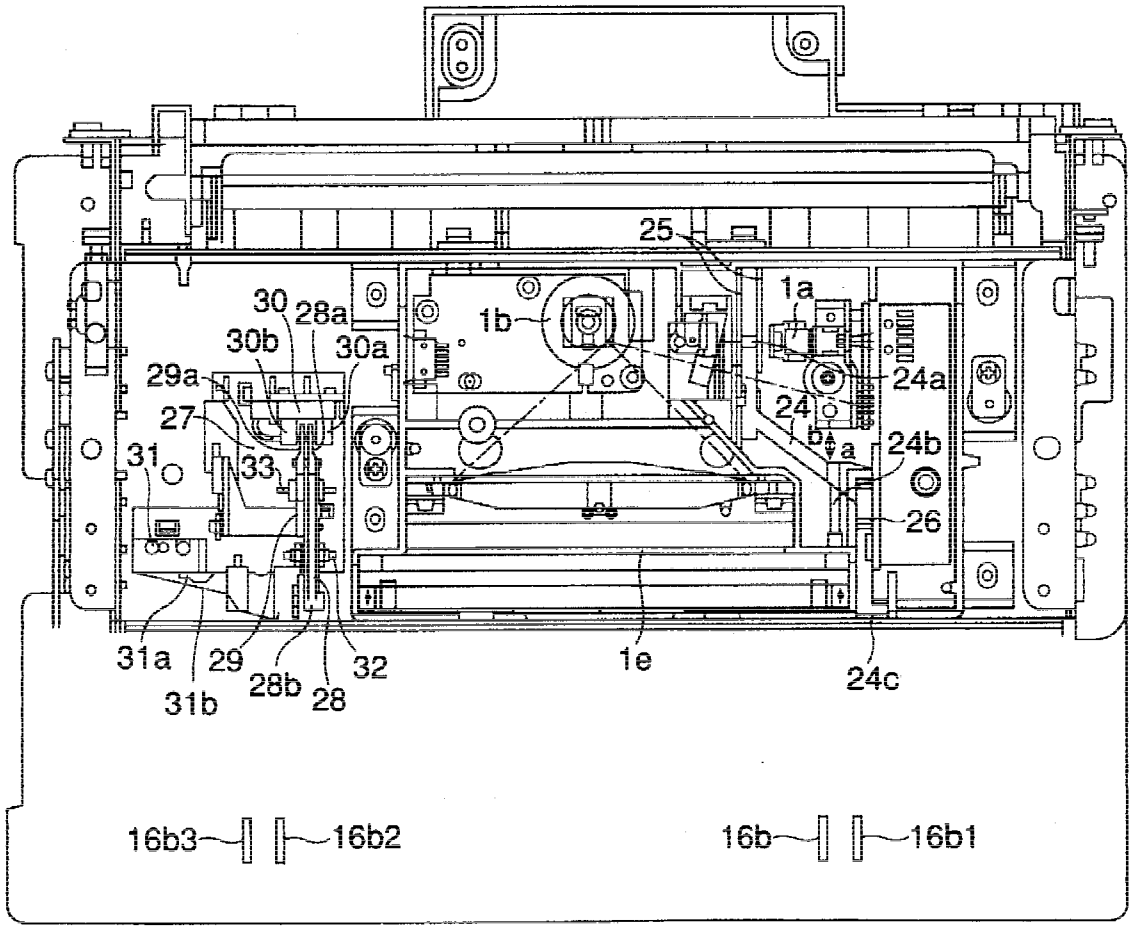
FIG. 10 is a schematic plan view showing a laser shutter and a sensor unit.
Figure 11A:
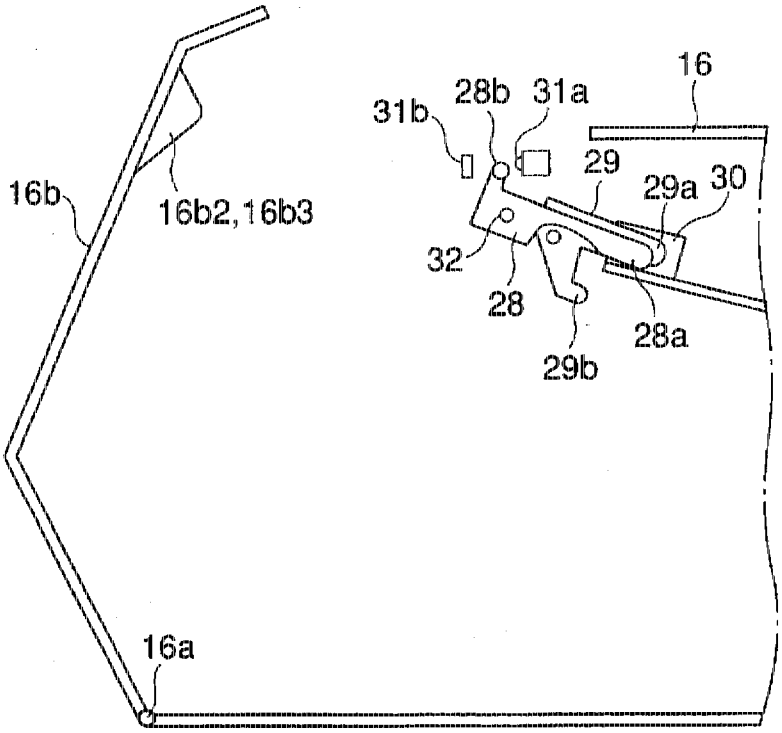
FIGS. 11A and 11B are schematic illustrations for showing a mechanism for detecting opening/closing of an opening/closing cover, a mechanism for detecting presence/absence of the process cartridge and an interlock detection mechanism.
Figure 11B:
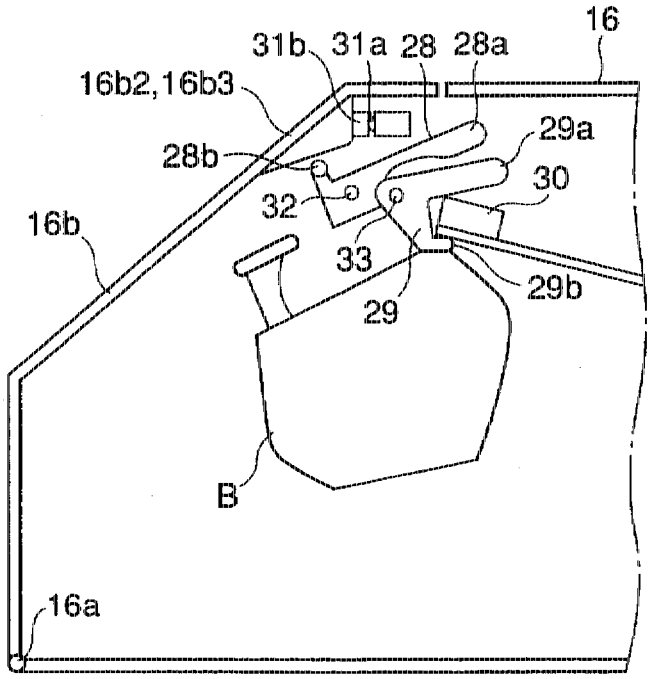

FIG. 10 is a plan view showing the sensor arrangement, and FIGS. 11A and 11B are views for showing the detection of the opening/closing of the opening/closing cover 16*b*. In FIG. 10, the optical means 1 is disposed at an upper portion of the apparatus body 15, and a laser shutter 24 is disposed between the laser diode 1*a* and the polygon mirror 1*b* of the optical means 1. The laser shutter 24 can be slid along guides 25 in directions shown by the double-headed arrow a-b and is always biased toward the direction a by means of a biasing spring 26, so that a stopper 24*b* abuts against a frame 1*e* of the optical unit. A laser shutter 24 is provided at its one end with an uprightly extended shutter portion 24*a*, and is provided at its other end with an abutment portion 24*c* against which a rib (operation portion) 16*b*1 protruded from the inner surface of the opening/closing cover 16*b* can abut.

When the opening/closing cover 16*b* is opened, as shown in FIG. 10, the stopper 24*b* of the laser shutter 24 abuts against the frame 1*e*. In this condition, the shutter portion 24*a* is positioned between the laser diode 1*a* and the polygon mirror 1*b* to block the laser light from the diode 1*a* to the polygon mirror 1*b*. Thus, in the condition that the opening/closing cover 16*b* is opened, the laser light is blocked by the shutter 24 and cannot be emitted from the laser unit 1*e* to the outside.

On the other hand, when the opening/closing cover 16*b* is closed, the abutment portion 24*c* is pushed by the rib 16*b*1 in a direction shown by the arrow b to slide the shutter 24 toward that direction. As a result, the shutter portion 24 is shifted out of the position between the laser diode 1*a* and the polygon mirror 1*b*. Consequently, the laser light emitted from the diode 1*a* can be illuminated onto the photosensitive drum 7 through the polygon mirror 1*b*. In this when the opening/closing cover 16*b* is opened the laser light is blocked, and when the opening/closing cover 16*b* is closed the laser light can reach the photosensitive drum 7.

Further, at the upper part of the apparatus body 15, there is also provided a sensor unit 27 disposed adjacent to the optical unit 1*e*. The sensor unit 27 includes a detection member 28 for detecting the opening/closing of the opening/closing cover 16*b*, a detection member 29 for detecting the mounting of the process cartridge B, a photo-interrupter (detection sensor) 30 for detecting these detection members 28, 29, and an interlock switch 31 for turning OFF a high voltage source of a power source 15*a* of the apparatus in response to the opening of the opening/closing cover 16*b*.

As shown in FIGS. 10, 11A and 11B, the opening/closing detection member 28 is formed from a plate member rockable around a shaft 32, and a tip end portion 28*a* of the detection member 28 is positioned between a light emitting element 30*a* and a light receiving element 30*b* of the photo-interrupter 30. On the other hand, a rib (operation portion) 16*b*2 formed on the inner surface of the opening/closing cover 16*b* can abut against the other end (base end) 28*b* of the detection member 28. Thus, as shown in FIGS. 11A and 11B, when the opening/closing cover 16*b* is opened, the tip end portion 28*a* of the detection member 28 is positioned between the light emitting element 30*a* and the light receiving element 30*b* by its own weight to block the light therebetween, thereby turning OFF the photo-interrupter 30 (FIG. 11A). On the other hand, when the opening/closing cover 16*b* is closed, the rib 16*b*2 abuts against the base end 28*b* of the detection member 28, thereby pushing the base end 28*b* downwardly along the inclined surface of the rib 16*b*2. As a result, the tip end portion 28*a* is shifted above the photo-interrupter 30 (FIG. 11B), thereby turning ON the photo-interrupter 30.

Similar to the opening/closing detection member 28, the mounting detection member 29 is formed from a plate member rockable around a shaft 33, and a tip end portion 29*a* of the detection member 28 is positioned between the light emitting element 30*a* and the light receiving element 30*b* of the photo-interrupter 30. On the other hand, as shown in FIGS. 11A and 11B, the other end (base end) of the detection member 29 is extended downwardly into the cartridge mounting space. Thus, in the condition that the process cartridge B is not mounted, the tip end portion 29*a* is positioned between the light emitting element 30*a* and the light receiving element 30*b* by its own weight to block the light therebetween, thereby turning OFF the photointerrupter 30 (FIG. 11A). On the other hand, when the process cartridge B is mounted, since the base end 29*b* is pushed upwardly by the process cartridge B, the tip end portion 28*a* is shifted above the photo-interrupter 30 (FIG. 11B), thereby turning ON the photo-interrupter 30.

The photo-interrupter 30 is turned ON when both the opening/closing detection member 28 and the mounting detection member 29 are shifted upwardly (i.e., when the process cartridge B is mounted and when the opening/closing cover 16*b* is closed) and is not turned ON when either of the members 28, 29 is not shifted upwardly (i.e., when the process cartridge B is not mounted or when the opening/closing cover 16*b* is not closed).

In this way, according to the illustrated embodiment, the mounting of the process cartridge B and the closing of the opening/closing cover 16*b* can be detected by the single sensor 30.

As shown in FIG. 10, the interlock switch 31 acting as a power source switch is activated by depressing an actuator 31*a* by a leaf spring member 31*b*. A rib (operation portion) 16*b*3 is protruded from the inner surface of the opening/closing cover 16*b*. When the opening/closing cover 16*b* is closed, the rib 16*b*3 urges the leaf spring member 16*b*3, thereby depressing the actuator 31*a* to turn ON the switch 31 (FIG. 11A). On the other hand, when the opening/closing cover 16*b* is opened, since the leaf spring member 31*b* is elastically returned to its original position, the actuator 31*a* is not depressed, thereby turning OFF the switch 31 (FIG. 11B).

When the interlock switch 31 is turned OFF, the power source of the apparatus is automatically turned OFF, with the result that, when the opening/closing cover 16*b* is opened and the process cartridge B is exchanged, the power source is maintained to the OFF condition.

With the arrangement as mentioned above, by opening and closing the opening/closing cover 16*b*, the laser shutter 24 is operated, the opening and closing of the opening/closing cover 16*b* can be detected and the power source can be turned ON or OFF. Further, since the sensor unit 27 is disposed at the upper part of the apparatus body 15 within a vacant space adjacent to the optical unit, the space in the apparatus body can be used efficiently, thereby permitting the compactness of the apparatus.

Further, as mentioned above, since the sensor unit 27 is disposed at the upper part of the apparatus body, the movement range of the ribs 16*b*1, 16*b*3 for activating the laser shutter 24 and the leaf spring member 31*b* of the interlock switch 31 can be increased, thereby maintaining the wide operation range of the actuator 31*a*. Thus, the laser shutter 24 and the actuator 31*a* can be operated within a wider range, thereby operating these elements positively.

{Support for Fixing Means}

When the mounting of the process cartridge B and the closing of the opening/closing cover 16*b* are detected by a control portion 200 (FIG. 14), the image formation can be started. For example, when an image formation start signal is sent from a host computer 100 to the control portion 200, the above-mentioned electrophotographic image forming process is executed.

As shown in FIG. 1, the fixing means 5 is constituted by a fixing rotary member 5*b* comprised of an endless film wound around a support 5*d*, a pressure roller 5*c* urged against the fixing rotary member 5*b*, and a heater 5*a* contacted with an inner surface of the film at a contact position between the fixing rotary member and the pressure roller. When the pressure roller (pressure rotary member) 5*c* is rotated, the fixing rotary member 5*b* is driven by the rotation of the pressure roller. While the recording sheet 2 is being passed between the rotary members 5*b* and 5*c*, the toner image is fixed to the recording sheet 2 by heat and pressure. Now, a mechanism for supporting the pressure roller 5*c* of the fixing means will be explained.

Figure 12:
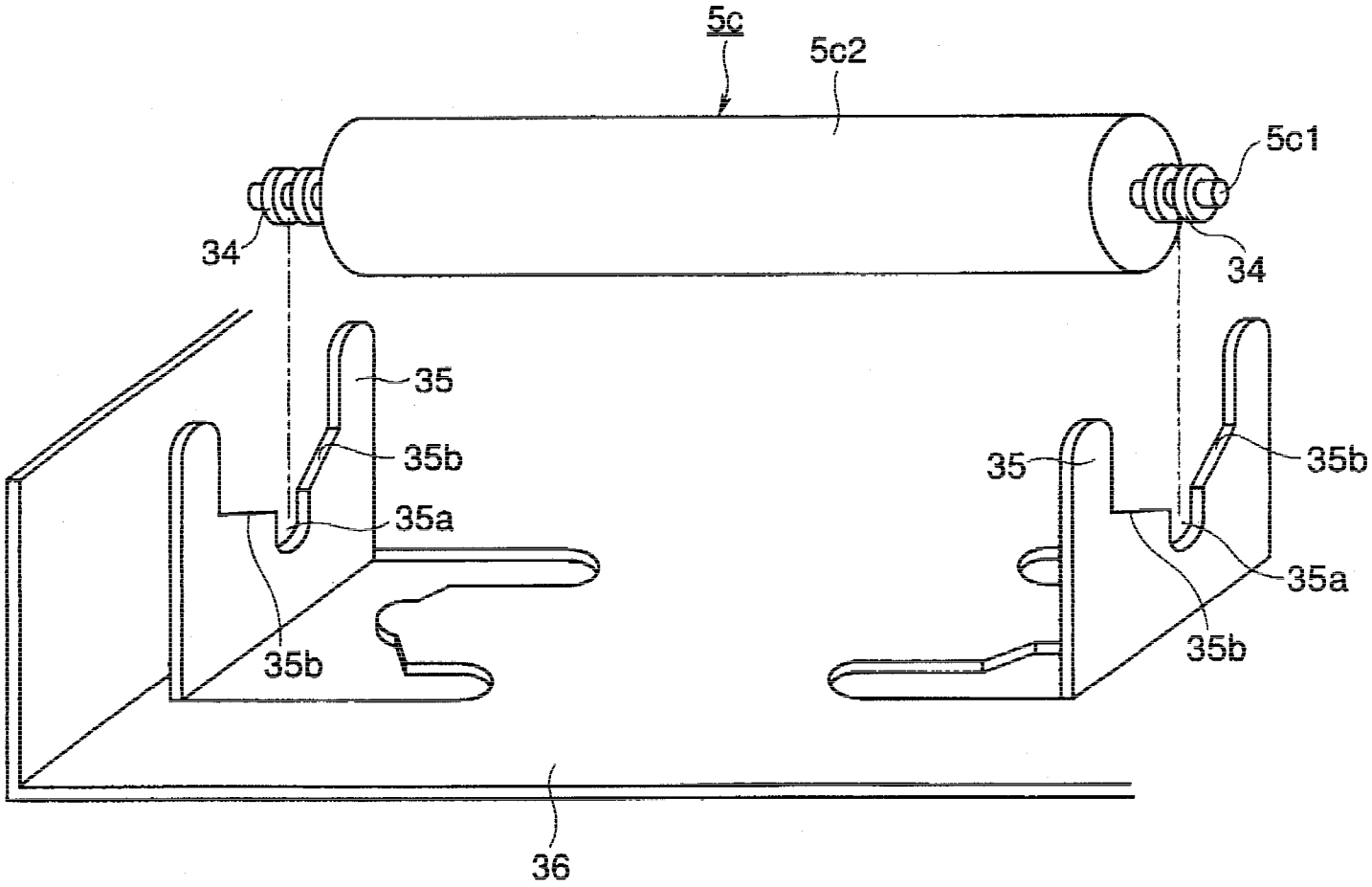
FIG. 12 is a perspective view showing a construction for supporting a pressure roller of a fixing device.

As shown in FIG. 12, the pressure roller 5*c* comprises a roller shaft 5*c*1, and a roller portion 5*c*2 made of heat-resistance rubber, and the roller shaft 5*c*1 is rotatably supported by bearings 34. The bearings 34 are secured to supporting portions 35. The supporting portions 35 are formed by bending portions of a metal chassis 36 of the apparatus body 15. Each supporting portion 35 is provided with a U-shaped fixing recess 35*a*. By fitting the bearings 43 into the fixing recesses 35*a*, the pressure roller 5*c* is rotatably attached to the chassis 36. Incidentally, each fixing recess 35*a* is contiguous to upwardly inclined receiving portions 35*b* to facilitate the introduction of the bearing 34 into the corresponding fixing recess 35*a*.

In the prior art techniques, a pressure roller and a fixing roller were formed as a fixing unit and the fixing unit was incorporated into an apparatus body. To the contrary, according to the illustrated embodiment of the present invention, the pressure roller 5*c* can be directly attached to the apparatus body 15. And, since the supporting portions 35 are formed by bending portions of the metal chassis 36 of the apparatus body 15, the parallelism between the roller shaft 5*c*1 and the apparatus body 15 (chassis 36) can easily be achieved. Further, the positional accuracy of the pressure roller 5*c* with respect to the apparatus body 15 can be improved. In addition, since it is not required to provide additional members for supporting the bearings, the number of parts can be reduced, thereby making the entire apparatus cheaper.

{Discharge Portion for Recording Sheet}

As mentioned above, the recording sheet 2 to which the toner image is fixed is discharged onto the discharge portion 6. Now, the discharge portion 6 will be fully described.

As shown in FIG. 1, the discharge portion 6 is formed in the opening/closing cover 16*b*. More particularly, when the opening/closing cover 16*b* is molded from resin material, a tubular wall portion 16*b*5 is formed integrally with the inner surface of the cover 16*b*, which tubular wall portion constitutes the discharge portion 6.

In the image forming apparatus according to the illustrated embodiment. After the image is formed on the recording sheet 2 conveyed in the longitudinal direction, the recording sheet 2 is discharged in the substantially upright condition. A support rib 16*b*4 is integrally formed with an inner surface of the tubular wall portion 16*b*5, and the discharged recording sheets 2 are supported by the support rib 16*b*4. With this arrangement, even when the long recording sheet is discharged, the recording sheet is not laid down (incidentally, when the large size recording sheets 2 are discharged, an auxiliary tray 41 may be added to the discharge portion 6, as shown in FIG. 1).

In the prior art, when recording sheets are discharged in the upright condition, the recording sheets must be supported by a bent wire to prevent the recording sheet from being laid down. With this arrangement, the bent wire (additional part) must be attached to the apparatus body. To the contrary, in the illustrated embodiment of the present invention, since the recording sheets are discharged into the tubular portion of the discharge portion 6 formed in the opening/closing cover 16*b*, unlike to the prior art, an additional bent wire is not required, with the result that the number of parts can be reduced and the assembling efficiency can be improved, thereby making the manufacturing cost of the apparatus cheaper.

Further, by forming the tubular portion 16*b*5 in the opening/closing cover 16*b*, the rigidity of the opening/closing cover 16*b* made of resin material is increased, thereby preventing the flexion of the cover. Accordingly, as mentioned above, the ribs 16*b*1 to 16*b*3 formed on the opening/closing cover 16*b* can operate the sensor and the like positively.

{Support for Lead Wires}

Next, a support structure for supporting lead wires will be explained. The above-mentioned interlock switch 31 and the like are electrically connected to the power through lead wires. In the illustrated embodiment, as shown in FIG. 13, a wire bundle 37 comprised of a plurality of lead wires is secured to a lead wire support member 38, and the support member 38 is attached to the side surface of the chassis 21, thereby supporting the wire bundle 37.

Figure 13:
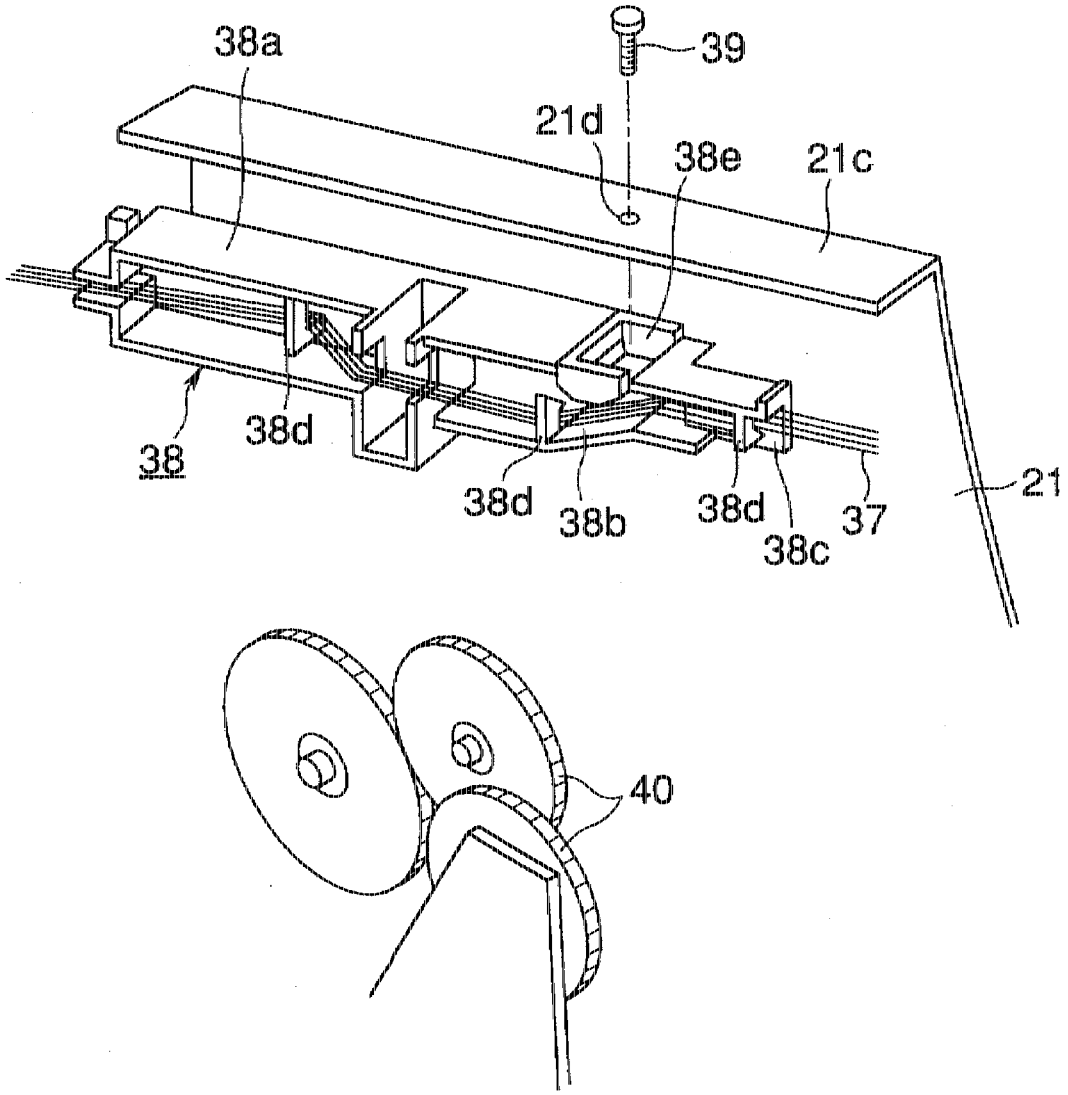
FIG. 13 is a partial perspective view showing a lead wire supporting member.

As shown in FIG. 13, the lead wire support member 38 has a length substantially the same as that of the upper side surface of the chassis 21 and includes an upper plate 38*a*, a lower plate 38*b* and a side plate 38*c* which form a body defining a laid U-shaped cross-section and capable of containing the wire bundle 37. A plurality of locking pawls 38*d* are formed between the upper plate 38*a* and the lower plate 38*b*, which locking pawls serve to lock the wire bundle 37. Further, locking portions (not shown) are formed on a back surface (near the chassis 21) of the side plate 38*c* by press-fitting these locking portions into corresponding locking holes (not shown) formed in the chassis 21, the lead wire support member 38 is attached to the chassis 21.

Since the support member 38 had a length substantially the same as that of the upper side surface of the chassis 21 along which the wire bundle 37 is to be arranged, the wiring of the wire bundle can be facilitated and the contact between the wire bundle 37 and the metal chassis 21 can be prevented. Further, a cup-shaped small recess 38*e* is formed in the upper plate 38*a* at a predetermined position. The position of the recess 38*e* is aligned with a threaded hole 21*d* formed in an upper bent portion 21*c* of the chassis 21 in a vertical direction.

The outer cover 16 is secured to the metal chassis 21 by threading a cover securing screw 39 into the threaded holes 21*d* of the bent portion 21*c*. In this case, it is apprehended that, when the screw is threaded into the threaded hole, a small amount metal powder is dropped into the interior of the apparatus body. However, in the illustrated embodiment, since the lead wire support member 38 is attached below the bent portion 21*c* of the chassis and the recess 38*e* is positioned below the threaded hole 21*d*, even if the metal powder is dropped, the dropped powder is received by the recess 38*e*, thereby preventing the dropped powder entering into the interior of the apparatus body. Therefore, although a gear train 40 is disposed near the side surface of the metal chassis 21, the metal powder does not drop onto the gear train, preventing the gearing accuracy of the gear train from being worsened.

Figure 14:
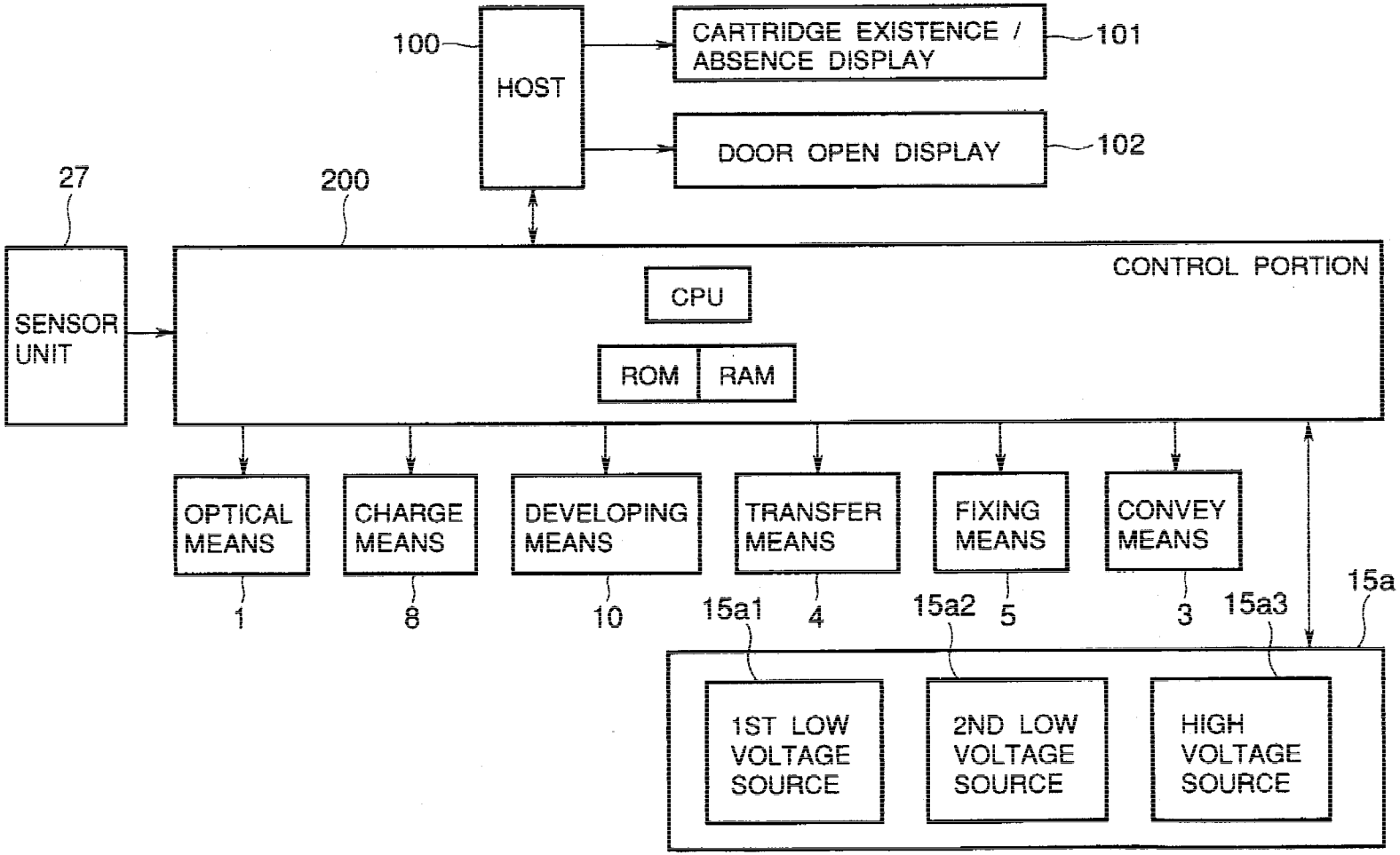
FIG. 14 is a functional block diagram.

Incidentally, FIG. 14 is a functional block diagram of the laser beam printer according to the illustrated embodiment.

In FIG. 14, the control portion 200 serves to control the entire apparatus and includes a CPU such as a microcomputer, a ROM for storing control programs for the CPU and various data, and a RAM for temporarily storing various data and adapted to be used as a work area for the CPU.

The host 100 is constituted by a computer or a word processor, for example, and transmission of electrical signals is effected between the control portion 200 and the host 100. As mentioned above, when the fact that the process cartridge B is not mounted on the apparatus body 15 is detected by the sensor unit 27, a detection signal is sent to the control portion 200. As a result, the control portion 200 causes a predetermined display 101 to display "cartridge absence" through the host 100. On the other hand, when the opening of the opening/closing cover 16*b* is detected by the sensor unit 27, a detection signal is sent to the control portion 200. As a result, the control portion 200 causes a predetermined display 102 to display "door open" through the host 100.

When the fact that the process cartridge B is not mounted on the apparatus body 15 or/and the fact that the opening/closing cover 16*b* is not closed is detected by the sensor unit 27, the control portion 200 deactivates (turns OFF) a high voltage source 15*a*3 of the electric power source 15*a* of the apparatus, thereby not starting the image formation. Incidentally, the power source 15*a* includes a first low voltage source 15*a*1 for driving the CPU, laser and the like, a second low voltage source 15*a*2 for mainly driving motors and the like, and the above-mentioned high voltage source 15*a*3 for applying the voltage to the transfer roller 4, developing roller 10*d* and charge roller 8 sufficient to effect the image forming process. In the illustrated embodiment, when the opening/closing cover 16*b* is opened, the high voltage source 15*a*3 is turned OFF not only by a software manner but also mechanically by the interlock switch 31. Incidentally, the high voltage source 15*a*3 can supply high voltage of about 1 to 4 kV.

Further, the control portion 200 can control the optical means 1, charge means 8, developing means 10, transfer roller 4, fixing means 5, convey means 3 and electric power source 15*a* on the basis of the information from the host 100 and the sensor unit 27.

[Other Embodiments]

Next, other embodiments of various members constituting the process cartridge B will be explained.

The process cartridge B used with the image forming apparatus can be applied to not only the above-mentioned mono-color image formation but also plural color image (for example, two-color image, three-color image or full-color image) formation.

Further, the developing method may be a conventional two-component magnetic brush developing method, cascade developing method, touch-down developing method, cloud developing method or any other developing method.

The electrophotographic photosensitive member is not limited to the photosensitive drum. For example, a photo-conductive body can be used as the photosensitive body. In this case, the photo-conductive body may be, for example, amorphous silicone, amorphous selenium, zinc oxide, titanium oxide or organic photo-conductive (OPC) material. Further, the photosensitive body may be mounted on a rotary member such as a drum and a endless belt, or on a sheet. Generally, the photosensitive body is mounted on the drum-shaped rotary member or the belt-shaped rotary member. For example, the drum-shaped photosensitive member is constituted by a cylinder made of aluminum or alloy thereof, and a photo-conductive layer coated or deposited on the cylinder In the illustrated embodiment, while an example that the charge means of so-called contact charging type is used was explained, any conventional charge means can be utilized. For example, a U-shaped three-wall member formed from a tungsten wire enclosed by an aluminum shield may be used, and positive or negative ions generated by applying high voltage to the tungsten wire may be transferred onto the surface of the photosensitive drum, thereby uniformly charging the photosensitive drum.

Incidentally, the charge means may be of blade (charging blade) type, pad type, block type, rod type or wire type, as well as the above-mentioned roller type.

Further, the cleaning means for removing the residual toner from the photosensitive drum may comprise a blade, a fur brush or a magnet brush.

The process cartridge includes an electrophotographic photosensitive member and at least one process means.

Thus, the process cartridge may incorporate therein an electrophotographic photosensitive member and a charge means as a unit which can be removably mounted to an image forming apparatus, or may incorporate therein an electrophotographic photosensitive member and a developing means as a unit which can be removably mounted to an image forming apparatus, or may incorporate therein an electrophotographic photosensitive member and a cleaning means as a unit which can be removably mounted to an image forming apparatus, or may incorporate therein an electrophotographic photosensitive member and two or more process means as a unit which can be removably mounted to an image forming apparatus.

That is to say, the process cartridge incorporates therein an electrophotographic photosensitive member, and a charge means, a developing means or a cleaning means as a unit which can be removably mounted to an image forming apparatus, or incorporates therein an electrophotographic photosensitive member, and at least one of a charge means, a developing means and a cleaning means as a unit which can be removably mounted to an image forming apparatus, or incorporates therein an electrophotographic photosensitive member and at least a developing means as a unit which can be removably mounted to an image forming apparatus.

In the above-mentioned embodiments, while an example that the image forming apparatus is embodied as the laser beam printer was explained, the present invention is not limited to such an example, but, the image forming apparatus may be embodied as an electrophotographic copying machine, a facsimile system or a word processor.

As mentioned above, according to the present invention, the guide members for guiding the mounting of the process cartridge are provided with not only the shutter guide portion for opening the shutter member but also the regulating projections for preventing the erroneous insertion of the process cartridge. Thus, since the erroneous insertion of the process cartridge can be prevented by the provision of the guide members, an additional means for preventing the erroneous insertion of the process cartridge is not required to be added to the image forming apparatus, thereby saving space and making the entire apparatus compact.

Further, since the guide members have locking projections by which the guide members can be locked to the apparatus body, the guide members can be attached to the apparatus body in a one-touch manner without using any screws, thereby improving the assembling ability of the image forming apparatus.

In addition, when the bent portions are provided on the guide members, metal pieces can effectively be prevented from dropping below the guide members.

What is claimed is:

1. A guide member for guiding a process cartridge when the process cartridge is removably mounted to a main body of an image forming apparatus, wherein said guide member is attached to the main body of the image forming apparatus and wherein the process cartridge includes an electrophotographic photosensitive member and at least one process means for acting on the electrophotographic photosensitive member, said guide member comprising:

(a) a cartridge guide portion for guiding a positioning projection, provided on the process cartridge, when the process cartridge is mounted to the main body of the image forming apparatus;

(b) a shutter guide portion for guiding a shutter projection provided on a shutter member of the process cartridge, the shutter member covering a transfer opening of the process cartridge, to open the shutter member when the process cartridge is mounted to the main body of the image forming apparatus; and (c) a regulating portion against which the shutter projection abuts when the process cartridge is inserted into the main body of the image forming apparatus in an erroneous state.

2. A guide member according to claim 1, wherein said shutter guide portion and said regulating portion are formed integrally.

3. A guide member according to claim 1, further comprising a locking pawl for attaching said guide member to the main body of the image forming apparatus.

4. A guide member according to claim 1, further comprising a bent portion for preventing foreign matter from dropping.

5. A guide member according to claim 1, wherein said cartridge guide portion, said shutter guide portion and said regulating portion are integrally molded from a plastic material.

6. An electrophotographic image forming apparatus to which a process cartridge including an electrophotographic photosensitive member and at least one process member acting on the electrophotographic photosensitive member is removably mounted, and which forms an image on a recording medium, said image forming apparatus comprising:

(a) a guide member for guiding the process cartridge when the process cartridge is removably mounted to a main body of said image forming apparatus, said guide member including a cartridge guide portion for guiding a positioning projection provided on the process cartridge when the process cartridge is mounted to said main body of said image forming apparatus, a shutter guide portion for guiding a shutter projection provided on a shutter member of the process cartridge, the shutter member covering a transfer opening of the process cartridge, to open the shutter member when the process cartridge is mounted to said main body of said image forming apparatus, and a regulating portion against which the shutter projection abuts when the process cartridge is inserted into said main body of said image forming apparatus in an erroneous state;

(b) a fixing member for fixing a toner image transferred from the electrophotographic photosensitive member to the recording medium; and (c) a convey member for conveying the recording medium.

7. An image forming apparatus according to claim 6, wherein said shutter guide portion and said regulating portion are formed integrally.

8. An image forming apparatus according to claim 6, further comprising a locking pawl for attaching said guide member to said main body of said image forming apparatus.

9. An image forming apparatus according to claim 6, further comprising a bent portion for preventing foreign matter from dropping.

10. An image forming apparatus according to claim 6, wherein said cartridge guide portion, said shutter guide portion and said regulating portion are integrally molded from plastic material.

11. A guide member for guiding a process cartridge when the process cartridge is removably mounted to a main body of an image forming apparatus, wherein said guide member is attached to the main body of the image forming apparatus and wherein the process cartridge includes an electrophotographic photosensitive member and at least one process member acting on the electrophotographic photosensitive member, said guide member comprising:

(a) a cartridge guide portion for guiding a positioning projection, provided on the process cartridge, when the process cartridge is mounted to the main body of the image forming apparatus, said cartridge guide portion having a positioning recess for positioning the positioning projection;

(b) a shutter guide portion for guiding a shutter projection provided on a shutter member of the process cartridge, the shutter member covering a transfer opening of the process cartridge, to open the shutter member when the process cartridge is mounted to the main body of the image forming apparatus;

(c) a regulating portion against which the shutter projection abuts when the process cartridge is inserted into the main body of the image forming apparatus in an erroneous state where a front portion and a rear portion of the process cartridge are reversed; and (d) a locking pawl member for attaching said guide member to the main body of the image forming apparatus.

12. A guide member according to claim 11, further comprising a bent portion for preventing foreign matter from dropping, said bent portion being positioned at a lower portion of said guide member when said guide member is attached to the image forming apparatus.

13. A guide member according to claim 11, wherein said cartridge guide portion is an elongated slot, and said positioning recess is disposed contiguous with said elongated slot.

14. A guide member according to claim 11, wherein said shutter guide portion is an inclined surface, and said regulating portion is disposed in a vicinity of said inclined surface.

15. A guide member according to claim 11, wherein said locking pawl member is locked to at least one locking hole provided in a metal chassis of the main body of the image forming apparatus when said guide member is attached thereto.

16. A guide member according to one of claims 11 to 14, wherein said cartridge guide portion, said positioning recess, said shutter guide portion and said regulating portion are integrally molded from plastic material.

17. An electrophotographic image forming apparatus to which a process cartridge including an electrophotographic photosensitive member and at least one process member acting on the electrophotographic photosensitive member is removably mounted, and which forms an image on a recording medium, said image forming apparatus comprising:

(a) a guide member for guiding the process cartridge when it is removably mounted to a main body of said image forming apparatus, said guide member including a cartridge guide portion for guiding a positioning projection provided on the process cartridge when the process cartridge is mounted to said main body of said image forming apparatus, said cartridge guide portion having a positioning recess for positioning the positioning projection, a shutter guide portion for guiding a shutter projection provided on a shutter member of the process cartridge, the shutter member covering a transfer opening of the process cartridge, to open the shutter member when the process cartridge is mounted to said main body of said image forming apparatus, a regulating portion against which the shutter projection abuts when the process cartridge is inserted into said main body of said image forming apparatus in an erroneous state where a front portion and a rear portion of the process cartridge are reversed, and a locking pawl member for attaching said guide member to said main body of said image forming apparatus;

(b) fixing means for fixing a toner image transferred from the electrophotographic photosensitive member to the recording medium; and (c) convey means for conveying the recording medium.

18. An image forming apparatus according to claim 17, further comprising a bent portion for preventing foreign matter from dropping, said bent portion being positioned at a lower portion of said guide member when said guide member is attached to said main body of said image forming apparatus.

19. An image forming apparatus according to claim 17, wherein said cartridge guide portion is an elongated slot, and said positioning recess is disposed contiguous with said elongated slot.

20. An image forming apparatus according to claim 17, wherein said shutter guide portion is an inclined surface, and said regulating portion is disposed in a vicinity of said inclined surface.

21. An image forming apparatus according to claim 17, wherein said locking pawl member is locked to at least one locking hole provided in a metal chassis of said main body of said image forming apparatus when said guide member is attached thereto.

22. An image forming apparatus according to one of claims 17 to 20, wherein said cartridge guide portion, said positioning recess, said shutter guide portion and said regulating portion are integrally molded from plastic material.

23. A guide member according to claim 1, wherein said process means is at least one of developing means for developing a latent image formed on the photosensitive member, charging means for charging the photosensitive member, and cleaning means for removing toner remaining on the photosensitive member.

24. An image forming apparatus according to claim 6 or 17, wherein the process member is at least one of a developing roller for developing a latent image formed on the photosensitive member, a charging roller for charging the photosensitive member, and a cleaning blade for removing toner remaining on the photosensitive member.

25. A guide member according to claim 11, wherein the process member is at least one of a developing roller for developing a latent image formed on the photosensitive member, a charging roller for charging the photosensitive member, and a cleaning blade for removing toner remaining on the photosensitive member.

* * * * *

UNITED STATES PATENT AND TRADEMARK OFFICE

CERTIFICATE OF CORRECTION

PATENT NO. : 5,708,922 Page 1 of 2

DATED : January 13, 1998

INVENTOR(S) : JUN AZUMA, ET AL.

It is certified that error appears in the above-identified patent and that said Letters Patent is hereby corrected as shown below:

COLUMN 2

Line 40, after "and" begin a new paragraph.

COLUMN 4

Line 64, "guide" should read --Guide--.

COLUMN 6

Line 10, "the" should be deleted.
Line 13, "provides" should read --provided--.

COLUMN 9

Line 10, "82" should read --θ2--.

COLUMN 10

Line 2, "this" should read --this way,--.

COLUMN 12

Line 31, "embodiment. After" should read --embodiment, after--.

UNITED STATES PATENT AND TRADEMARK OFFICE

CERTIFICATE OF CORRECTION

PATENT NO. : 5,708,922 Page 2 of 2

DATED : January 13, 1998

INVENTOR(S) : JUN AZUMA, ET AL.

It is certified that error appears in the above-identified patent and that said Letters Patent is hereby corrected as shown below:

COLUMN 13

Line 19, "had" should read --has--.

COLUMN 14

Line 43, "a" should read --an--.

Signed and Sealed this

Eighth Day of September, 1998

*Attest:*

Bruce Lehman

BRUCE LEHMAN

*Attesting Officer*

*Commissioner of Patents and Trademarks*